United States Patent [19]

Stevenson, IV et al.

[11] Patent Number: 4,838,192

[45] Date of Patent: Jun. 13, 1989

[54] MARINE SAILS WITH BATTENS AND FURLING SYSTEMS THEREFOR

[76] Inventors: William H. Stevenson, IV, 417 Talbot St., St. Michaels, Md. 21663; William H. Stevenson, III, Rt. 5, Box 532 Travellers Rest, Easton, Md. 21601; Aulby B. Bates, III, St. Michaels, Md.

[21] Appl. No.: 105,742

[22] Filed: Oct. 8, 1987

[51] Int. Cl.[4] ..... B63H 9/10

[52] U.S. Cl. ..... 114/105

[58] Field of Search ..... 114/102–105, 114/39.1, 39.2

[56] References Cited

U.S. PATENT DOCUMENTS

| | | | |
|---|---|---|---|
| 855,238 | 5/1907 | Ericson | 114/105 |
| 2,077,685 | 4/1937 | Gerhardt | 114/103 |
| 2,620,760 | 12/1952 | Melges | 114/103 |
| 2,724,356 | 11/1955 | Szakacs | 114/102 |
| 3,084,656 | 4/1963 | Johnson | 114/105 |
| 3,557,733 | 1/1971 | Mathieu et al. | 114/39.1 |
| 4,343,257 | 8/1982 | Stevenson | 114/104 |
| 4,354,444 | 10/1982 | Puretic | 114/105 |
| 4,365,572 | 12/1982 | Stevenson | 114/104 |
| 4,469,040 | 9/1984 | Gougeon et al. | 114/104 |
| 4,474,127 | 10/1984 | Stevenson | 114/105 |
| 4,633,798 | 1/1987 | Skinner | 114/107 |
| 4,686,921 | 8/1987 | Magnan | 114/103 |
| 4,688,506 | 8/1987 | van Breems | 114/104 |
| 4,699,073 | 10/1987 | Farneti | 114/103 |
| 4,741,281 | 5/1988 | Doyle | 114/102 |

*Primary Examiner*—Sherman D. Basinger

*Attorney, Agent, or Firm*—Roylance, Abrams, Berdo & Goodman

[57] ABSTRACT

A marine sail having a pocket, or double ply section, at the luff and a plurality of elongated battens which are attached to the sail at the leech and which extend forwardly along the sail and project through openings at the trailing edge of the double ply section so that the forward end portions of the battens are enclosed within the double ply section. The sail is furled into, and bagged within, the double ply section, and lines are provided within the double ply section for progressively pivoting the battens and moving them upwardly along the pocket during furling so that, when furling is completed, all of the battens are disposed in generally upright positions within the bag formed by the double ply section.

12 Claims, 2 Drawing Sheets

MARINE SAILS WITH BATTENS AND FURLING SYSTEMS THEREFOR

This invention relates to furling of mainsails when the sail is equipped with battens, and to new mainsails equipped with battens and capable of being furled against the mast.

BACKGROUND OF THE INVENTION

Though mainsails not equipped with battens have been furled against the mast, as disclosed for example in U.S. Pat. No. 4,343,257 issued to William H. Stevenson IV, addition of battens to a mainsail has heretofore required that the sail be furled against the boom. Thus, it has not heretofore been practical to furl a mainsail having battens while the sail is aloft and to then leave the furled sail aloft. Further, it has not heretofore been possible to both furl and bag a mainsail having battens while the sail is aloft. Accordingly, there has been a continuing need for a better approach to furling mainsails having battens.

SUMMARY OF THE INVENTION

Broadly considered, mainsails according to the invention have a "double luff" portion generally in accordance with Stevenson U.S. Pat. No. 4,343,257 and are equipped with elongated battens which are attached to the sail at the leech and which extend forwardly along the sail and project through openings at the trailing edge of the double luff so that the forward end portions of the battens are enclosed within the double luff. The sail is furled into, and bagged within, the double luff, and means are provided within the double luff for progressively pivoting the battens during furling so that, when furling is completed, all of the battens are disposed in generally upright position within the bag provided by the double luff.

IDENTIFICATION OF THE DRAWINGS

DETAILED DESCRIPTION OF THE INVENTION

Figures 1, 2:
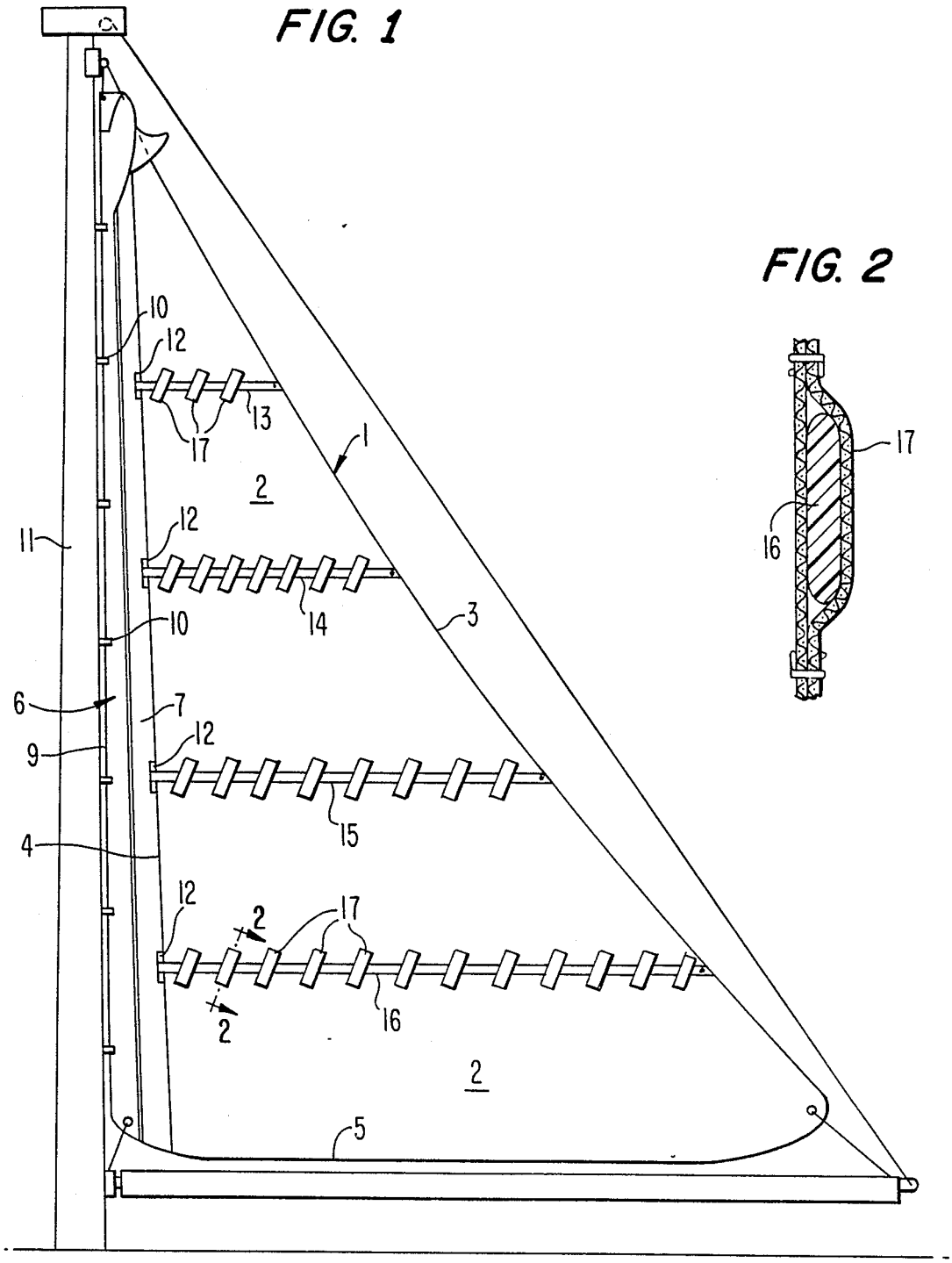
FIG. 1 is an elevational view of a mainsail according to one embodiment of the invention and shows the sail aloft and flying.
FIG. 2 is a cross-sectional view taken generally on line 2—2, FIG. 1.

Indicated generally at 1, the mainsail of this embodiment comprises a sail body 2 of flexible sail material having a generally triangular plan shape with a leech 3, a forward edge 4 and a foot 5. Forward edge 4 is stitched to the trailing edge of a double luff 6 comprising portions 7 and 8 which are each connected at their trailing edge to edge 4 of the sail body and at their forward edges to a luff tape 9 equipped with slides 10 engaged in a conventional slot in mast 11. Between edge

4 and luff tape 9, portions 7 and 8 are completely independent so as to form the double luff as described in U.S. Pat. No. Stevenson 4,343,257. Along the trailing edge of double luff, or pocket 6, a plurality of spaced openings 12 are provided by cutting rectangular notches in the flexible material of portion 7. The stitching which connects the trailing edges of portions 7 and 8 to the sail body simply extend across the notches, and the edges of portion 7 which define the notches are finished in any conventional fashion.

The sail is equipped with a plurality of elongated, moderately flexible battens 13–16. The battens can vary in dimensions and material, depending upon the size of the sail. Thus, for example, each batten can be formed by pultrusion from fiberglass-reinforced polymeric materials such as epoxy or polyethylene terephthalate and can have transverse cross-sectional dimensions of 1/16″–¼″ in thickness and ⅛″–2″ in width. The battens can be solid and of rectangular cross section or can be tubular. The battens typically extend at right angles to the luff and are secured at their trailing ends to the sail body at the leech, as by grommets or rivets. The sail is provided with a plurality of guide loops or tabs 17 which, for each batten, are spaced along the length of the batten 6″–3′apart, depending upon the size of the sail. As shown in FIG. 1, each loop 17 is formed by a rectangular strip of fabric extending across the batten and stitched or otherwise secured at its ends to the sail, the strip slanting upwardly and rearwardly. When the sail is flying, loops 17 act to constrain the battens and urge them properly against the sail, yet allow free movement of the battens lengthwise relative to the loops. As the sail is furled, the fabric strips which form loops 17 come more into vertical position, increasing the freedom of movement of the batten relative to the sail.

Figure 3:
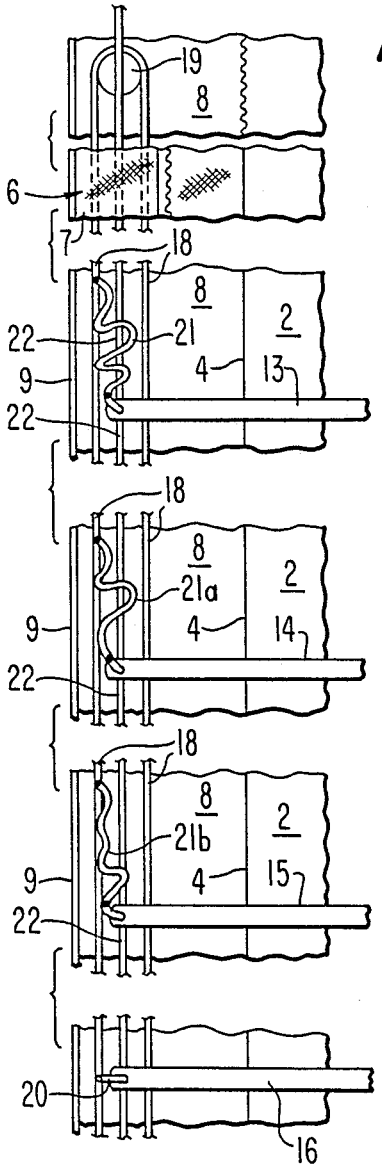
FIG. 3 is an enlarged view, partly in elevation but with parts broken away for clarity of illustration, showing the relationship between the double luff, the battens and means within the double luff.
Figure 4:
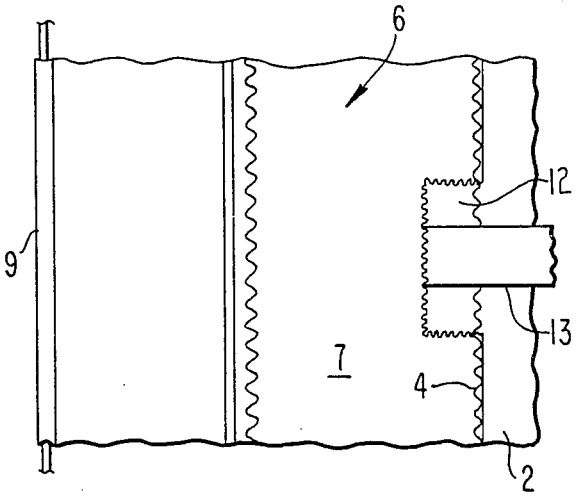
FIG. 4 is an enlarged fragmentary elevational view showing the manner in which the battens enter the double luff.

For positive manipulation of the battens, a line 18 is provided within the double luff. In this embodiment, line 18 is endless, running over an upper sheave 19 near the head of the sail and a lower sheave (not shown) near the foot. The forward run of line 18 extends near and runs parallel to the luff tape. The forward end of lowermost batten 16 is tied directly to the forward run of line 18, as at 20, FIG. 3, so that there is little freedom of forward and rearward movement of the batten relative to the line. The forward ends of battens 13–15 are connected to the forward run of line 18 by tab lines, as at 21, 21*a* and 21*b*, FIG. 3, the length of the tab lines increasing progressively from batten 15 to batten 13. A line 22 extending upwardly within the double luff is connected to the forward ends of the battens to prevent tab lines 21 from tangling with the battens.

Figure 5:
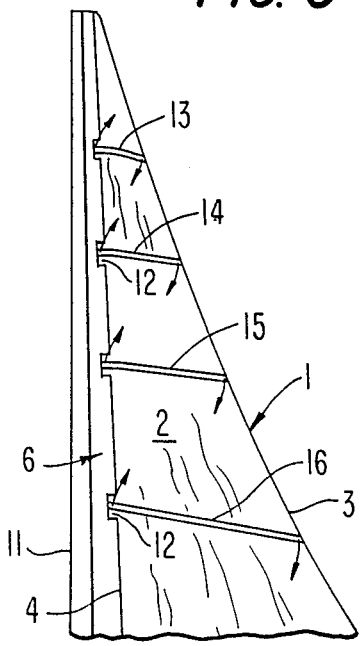
FIG. 5 is a diagrammatic view illustrating the manner in which the battens pivot during furling of the sail.
Figure 6:
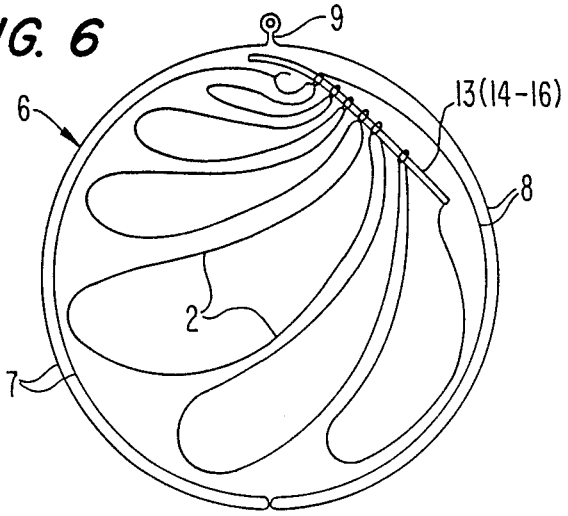
FIG. 6 is a diagrammatic cross-sectional view showing the sail after it is furled and bagged.

As the sail is furled, line 18 is manipulated to move its forward run upwardly, pulling the forward ends of the battens upwardly and thus pivoting the battens, as indicated in FIG. 5, until, with the sail furled and bagged, as shown in FIG. 6, all of the battens extend generally upwardly and are enclosed in the bag formed by the double luff.

What is claimed is:

1. A marine sail comprising, in combination a generally triangular sail body having a leech, and a forward edge spaced forwardly from the leech;

a luff portion comprising two portions of flexible sheet material each having a luff edge and a trailing edge, the trailing edges of said two portions each being secured to said forward edge of the sail body, there being a plurality of openings in the trailing portion of said luff portion which open forwardly into the space between said two portions of flexible sheet material;

a plurality of elongated flexible battens each having a trailing end connected to the sail body at the leech, said battens each extending from the leech forwardly through a different one of said openings into the space between said two portions of flexible sheet material; and means within the space between said two portions of flexible sheet material of the luff portion connected to the forward ends of the battens for pivoting the battens, during furling of the sail, until the battens are generally upright when the sail has been furled.

2. The combination defined by claim 1 and further comprising means secured to the sail and surrounding said battens to hold the battens in place but allow lengthwise movement of the battens relative to the sail as the sail is furled.

3. The combination defined by claim 2, wherein said means comprises a plurality of tabs spaced along the length of each batten, overlying the batten, and having the ends of the tabs secured to the sail.

4. The combination defined by claim 3, wherein each of said tabs is a length of fabric stitched at its ends to the sail body, each of said tabs slanting upwardly and rearwardly across the batten when the sail is flying.

5. The combination defined by claim 1, wherein said means for pivoting the battens comprises a manipulating line extending upwardly within the space between said two portions of flexible sheet material of the luff portion, and tab lines connecting the forward ends of the battens to said manipulating line.

6. The combination defined by claim 5, wherein the length of said tab lines increases progressively from foot to head of the sail.

7. The combination defined by claim 5 and further comprising a flexible line extending upwardly within the space between said two portions of flexible sheet material of the luff portion and connected to the forward ends of the battens in positions preventing said tab lines from tangling about the forward ends of the battens.

8. A marine sail comprising, in combination, a generally triangular sail body having a leech, and a forward edge spaced forwardly of the leech;

means extending along the forward edge of the sail body and defining an elongated pocket having an entrance opening;

an elongated batten having a trailing end portion and a forward end portion, the forward end portion of the batten extending in a direction to pass through said entrance opening;

means for coupling the batten to the sail body; and means extending within said pocket and connected to the forward end portion of the batten for moving the batten along said entrance opening and upwardly along said pocket.

9. A marine sail, the combination comprising:

a generally triangular sail body having a leech, a forward edge spaced forwardly of said leech, and a foot;

means, extending along said forward edge of said sail body, for defining an elongated pocket having an entrance opening;

an elongated flexible batten having a trailing end portion and a forward end portion;

means, coupled to said sail body and to said batten, for supporting said batten on said sail body; and means, extending within said pocket and connected to said forward end portion of said batten, for moving said batten along said entrance opening and upwardly along said pocket.

10. A marine sail defined by claim 9, wherein said means for supporting said batten includes means for initially positioning said batten generally parallel to said foot.

11. A marine sail, the combination comprising:

a generally triangular sail body having a first edge, a second edge, and a third edge;

means, extending along said second edge, for defining an elongated pocket having an entrance opening;

an elongated flexible batten having a first end portion and a second end portion;

means, coupled to said sail body and to said batten, for supporting said batten on said sail body; and means, extending within said pocket and connected to said first end portion of said batten, for moving said batten along said entrance opening and upwardly along said pocket.

12. A marine sail defined by claim 1, wherein said means for supporting said batten includes means for initially positioning said batten generally parallel to said third edge.

* * * * *